US007096586B2

(12) United States Patent
Carpenter et al.

(10) Patent No.: US 7,096,586 B2
(45) Date of Patent: Aug. 29, 2006

(54) COMBINED SCISSORS AND BOX CUTTER

(75) Inventors: David Carpenter, Pepperell, MA (US); Christoper Aiston, Nashua, NH (US)

(73) Assignee: Acme United Corporation, Fairfield, CT (US)

( * ) Notice: Subject to any disclaimer, the term of this patent is extended or adjusted under 35 U.S.C. 154(b) by 1126 days.

(21) Appl. No.: 10/162,041

(22) Filed: Jun. 3, 2002

(65) Prior Publication Data

US 2003/0221320 A1 Dec. 4, 2003

(51) Int. Cl.
*B26B 11/00* (2006.01)

(52) U.S. Cl. ..... 30/146; 30/2; 30/143

(58) Field of Classification Search ..... 30/131, 30/146, 341, 232, 2, 143; 7/131
See application file for complete search history.

(56) References Cited

U.S. PATENT DOCUMENTS

| | | | | |
|---|---|---|---|---|
| 348,749 | A * | 9/1886 | Kimbler | |
| 574,178 | A | 12/1896 | Stebbins | |
| 651,380 | A | 6/1900 | Odell | |
| 667,914 | A | 2/1901 | Klever, Jr. | |
| 812,740 | A | 2/1906 | Harris et al. | |
| 1,017,545 | A | 2/1912 | Hopkins | |
| 1,182,561 | A * | 5/1916 | Hanscom | 30/146 |
| 1,208,202 | A | 12/1916 | Piggott | |
| 1,423,127 | A | 7/1922 | Levy | |
| 2,131,395 | A | 9/1938 | Voss | |
| 3,872,590 | A | 3/1975 | Hill | |

* cited by examiner

*Primary Examiner*—Hwei-Siu Payer
(74) *Attorney, Agent, or Firm*—Jonathan M. Fritz; Whyte Hirschboeck Dudek S.C.

(57) ABSTRACT

By providing a movable, separate, and independent blade member which is normally maintained in a stowed and hidden position, a combined, integrated, multi-purpose scissors and box cutting product is achieved. In the present invention, the combined, integrated, scissors and box cutting product incorporates two arm members pivotally mounted to each other, with each arm member incorporating a blade portion and a handle portion. In the preferred construction, the movable blade member is retained within one handle portion of one arm member of the combined, integrated, scissors and box cutting product, with the movable blade member being deployed for use only upon activation by the user. In this way, the blade member remains concealed and hidden within the handle portion of the arm member in order to prevent unwanted or accidental contact of the blade member when not desired.

17 Claims, 3 Drawing Sheets

COMBINED SCISSORS AND BOX CUTTER

TECHNICAL FIELD

This invention relates to multi-purpose cutting implements and, more particularly, to cutting implements constructed for cutting or shearing desired items or products, which also incorporates an easily deployed separate and independent blade member.

BACKGROUND ART

One stationery product that is widely used in virtually all homes and businesses is scissors. Due to the unique, widely divergent activities and applications for which scissors can be employed, these products are widely accepted and commonly found. Due to the ubiquitous nature of scissors, these products are often used in activities for which the scissors are not designed and are not properly constructed.

One such activity for which scissors are commonly used by many individuals is to open sealed boxes, packages, and the like. In using scissors for this purpose, one of the blade members is used as a cutting tool in an attempt to open any edge of the package or product which is accessible. However, due to the typical construction of scissors, the use of scissors for opening packages by cutting sealing tape, strapping tape, and the like has proven difficult, inconvenient, cumbersome, and undesirable. In this regard, a user often finds that an attempt to use a pair of scissors to open packages causes items retained in the package to be inadvertently cut or destroyed.

In order to avoid the use of scissors for purposes for which the scissors were not constructed, some businesses or homes have box cutters or slicing implements particularly constructed for opening packages by cutting the sealing tape associates therewith. However, most offices and businesses, which do not regularly open packages, do not have added cutting implements readily available. Consequently, typical scissors are employed with undesirable consequences.

In spite of the general need for a single product which is capable of providing both conventional cutting as well as the ability to cut or open sealed packages, no suitable product has been developed which is capable of satisfying this long-felt need. As a result, most consumers have been forced to continue to employ a conventional scissors product for purposes and functions beyond the conventional scissors capabilities.

Therefore, it is a principal object of the present invention to provide a scissors product which is capable of performing all of the conventional activities for which scissors are employed, while also incorporating an easily employed, readily activated independent cutting element for enabling the users to efficiently, quickly, and conveniently cut any sealing material associated with boxes and/or packages.

Another object of the present invention is to provide a single, combined scissors and box cutting product having the characteristic features described above which incorporates conventional cutting blades associated with typical scissors, while also incorporating a separate, independent box cutting or opening blade element which remains completely concealed when not in use.

Another object of the present invention is to provide a single, combined scissors and box cutting product having the characteristic features described above which provides a box opening or cutting blade which is quickly and easily activated by the user whenever desired.

Another object of the present invention is to provide a single, combined scissors and box cutting product having the characteristic features described above which is constructed to automatically maintain the box cutting blade concealed, when not in use, and quickly and easily deployed only when activated by the user.

Another object of the present invention is to provide a single, combined scissors and box cutting product having the characteristic features described above wherein the box cutting blade is constructed for automatically returning to the concealed position whenever the user removes the activating force.

Other and more specific objects will in part be obvious and will in part appear hereinafter.

SUMMARY OF THE INVENTION

By employing the present invention, all of the difficulties and drawbacks of the prior art have been overcome, and a combined, integrated, scissors and box cutting product is achieved. In the present invention, the combined, integrated, scissors and box cutting product incorporates two arm members pivotally mounted to each other, with each arm member incorporating a blade portion and a handle portion. In the present invention, the cooperating arm members are constructed in a generally, conventional manner for providing scissors which are capable of being operated in the normal, widely accepted and well-known manner.

In addition, in the present invention, the combined, integrated, scissors and box cutting product also incorporates a movable, separate, and independent blade member which is normally maintained in a stowed and hidden position. In the preferred construction, the movable blade member is retained within one handle portion of one arm member of the combined, integrated, scissors and box cutting product, with the movable blade member being deployed for use only upon activation by the user. In this way, the blade member remains concealed and hidden within the handle portion of the arm member in order to prevent unwanted or accidental contact of the blade member when not desired.

In accordance with the present invention, the movable blade member forming the box cutting element comprises a single, elongated blade member which is pivotally mounted in a receiving zone or cavity formed in one handle portion of one arm member. In addition, an activating trigger is cooperatively and controllably associated with the pivotable blade member in order to move the blade member from its normally stowed position to its activated, deployed position.

In addition, the trigger member is preferably associated with biasing means which are constructed for maintaining the blade member in the stowed and concealed position, requiring an activation force to move the trigger in order to achieve activation of the blade member. Furthermore, the biasing means are also constructed for returning the trigger to its original position, thereby assuring that the blade member is normally maintained in its concealed, stowed position.

A further feature preferably incorporated into the present invention is lock means which is associated with the trigger for preventing activation of the trigger when use is not desired. In this way, unwanted or accidental activation of the box cutting blade member is prevented whenever the lock means is engaged. As a result, enhanced safety and security are provided.

A further feature of the present invention is the achievement of a trigger member which is quickly and easily operated by the user, whenever desired, as well as being constructed for completely controlling the movement of the box opening, cutting blade. In this way, the box opening, cutting blade is maintained in a completely concealed position, when not in use, while also being quickly and easily activated into its deployed position for providing the desired box cutting or opening function. In addition, the combined, integrated, scissors and box cutting product of the present invention is constructed in a manner which positions the separate and independent box cutting blade member at a precise location on the handle portion of the arm member with which it is associated for optimizing its ease of use and maneuverability.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

By referring to FIGS. 1–6, along with the following detailed discussion, the construction and operation of the combined scissors and box cutting product of the present invention can best be understood. Although the drawings and detailed discussion fully disclose the preferred embodiment of the present invention, alternate constructions of the present invention can be made without departing from the scope of this invention. Consequently, it is to be understood that this detailed disclosure is intended for exemplary purposes only and is not intended as a limitation of the present invention.

Figure 1:
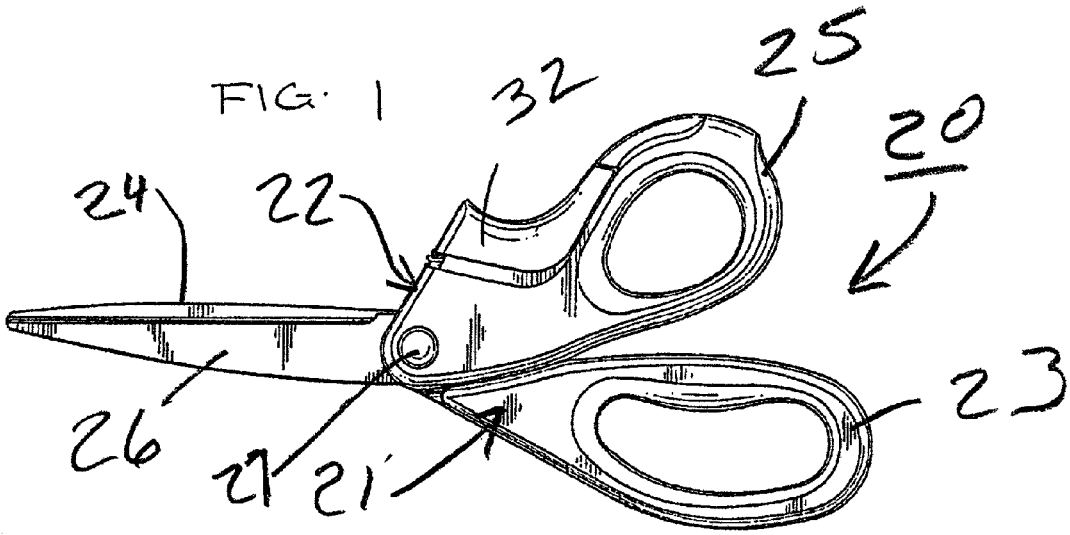
FIG. 1 is a front view of the combined scissors and box cutting product of the present invention depicted with the movable blade member in its stowed position.
Figure 2:
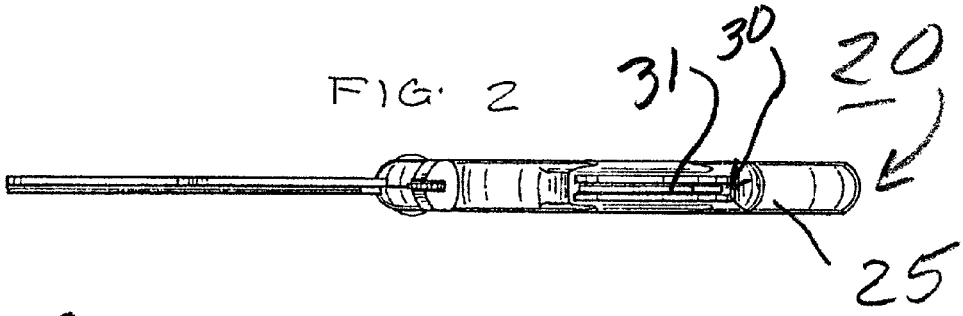
FIG. 2 is a top view of the combined scissors and box cutting product of FIG. 1.
Figure 3:
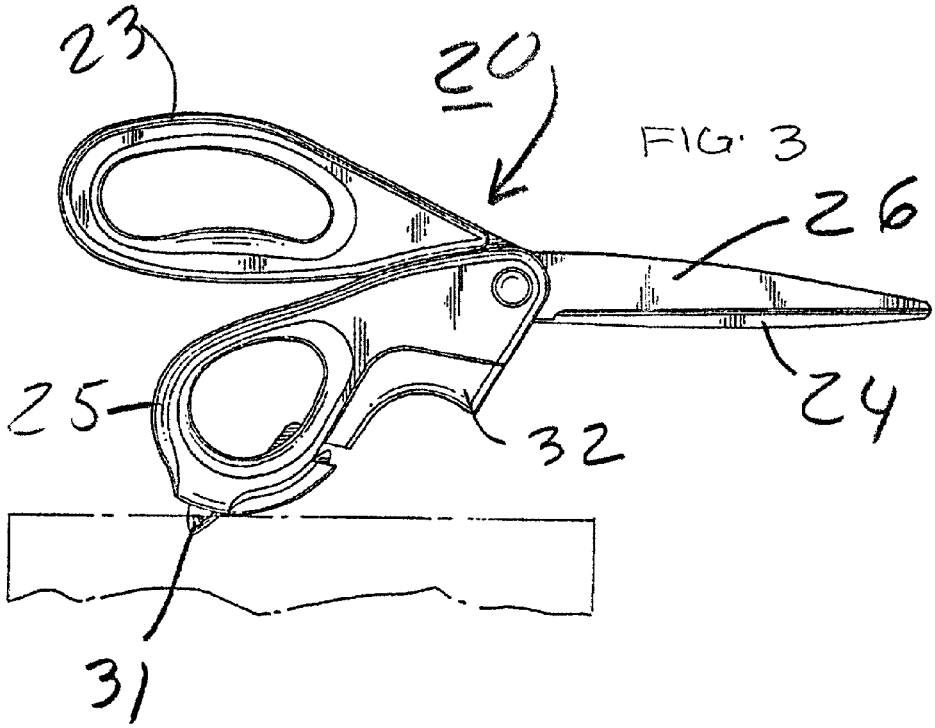
FIG. 3 is a rear view of the combined scissors and box cutting product of the present invention depicted with the movable blade member in the activated position in the process of being used.

As shown in FIGS. 1–3, combined, integrated, scissors and box cutting product 20 comprises arm member 21 and arm member 22. In addition, arm member 21 comprises handle portion 23 and blade portion 24, while arm member 22 comprises handle portion 25 and blade portion 26. In addition, as depicted, arm members 21 and 22 are pivotally mounted to each other about pivot pin 27 for enabling blade members 24 and 26 to be employed in the generally conventional manner.

Although FIGS. 1–6 and the following detailed discussion depict and refer to the combined scissors and box cutting product 20 of the present invention as a generally conventionally appearing pair of scissors, it is evident to one having ordinary skill in the art that other pivotable cutting products, such as shears, gardening tools, cutters, pruners, and the like, may all incorporate the present invention without departing from the scope of this invention.

In the preferred embodiment, scissors and box cutting product 20 of the present invention incorporates a cavity or open zone 30 formed in handle portion 25 of arm member 22, with zone 30 being dimensioned for receiving and retaining movable cutting blade 31. In addition, handle portion 25 also incorporates trigger 32 which is movably mounted to handle portion 25 for controlling the movement of cutting blade 31. Although trigger 32 may comprise a wide variety of alternate shapes and configurations, the preferred embodiment, as depicted in FIGS. 1 and 3, comprises a generally L-shaped trigger member which is constructed for conforming to the visual appearance of handle portion 25.

Figure 4:
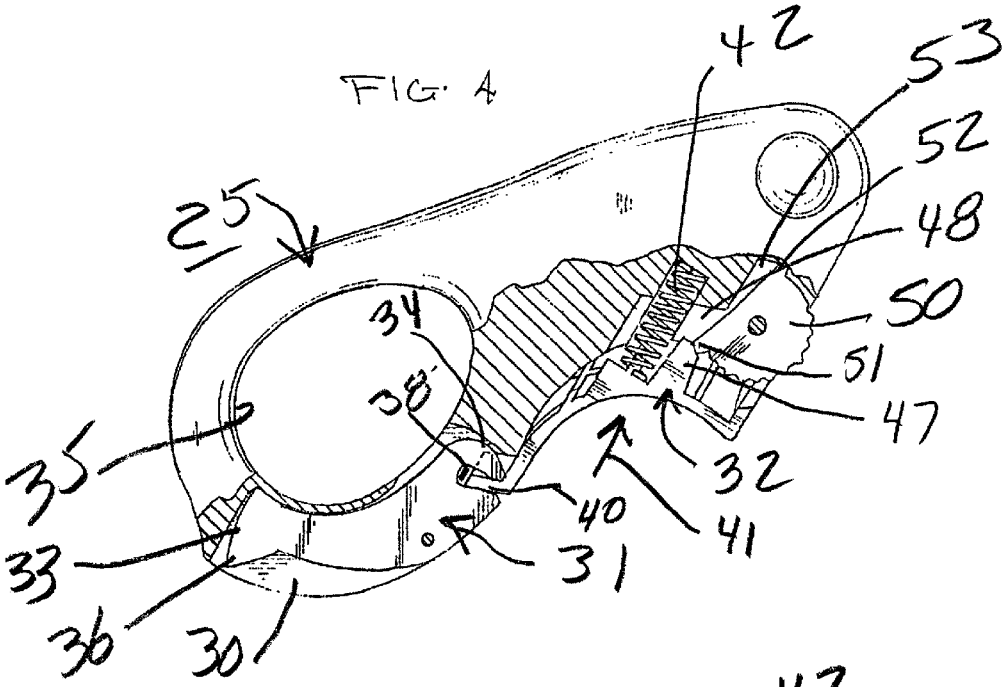
FIG. 4 is a front elevation view, partially in cross-section, of the arm member within which the movable blade member is retained, depicted with the blade member in its stowed position with the lock means engaged.
Figure 5:
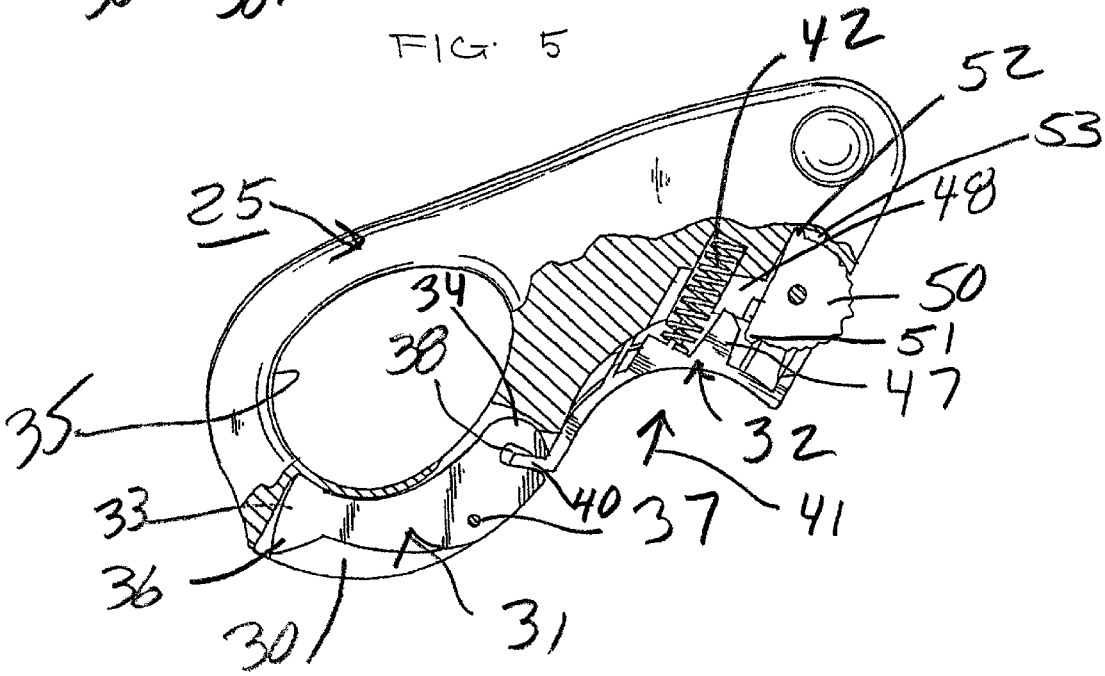
FIG. 5 is a front elevation view, partially in cross-section, of the arm member within which the movable blade member is retained, depicted with the blade member in its stowed position and the lock means disengaged.
Figure 6:
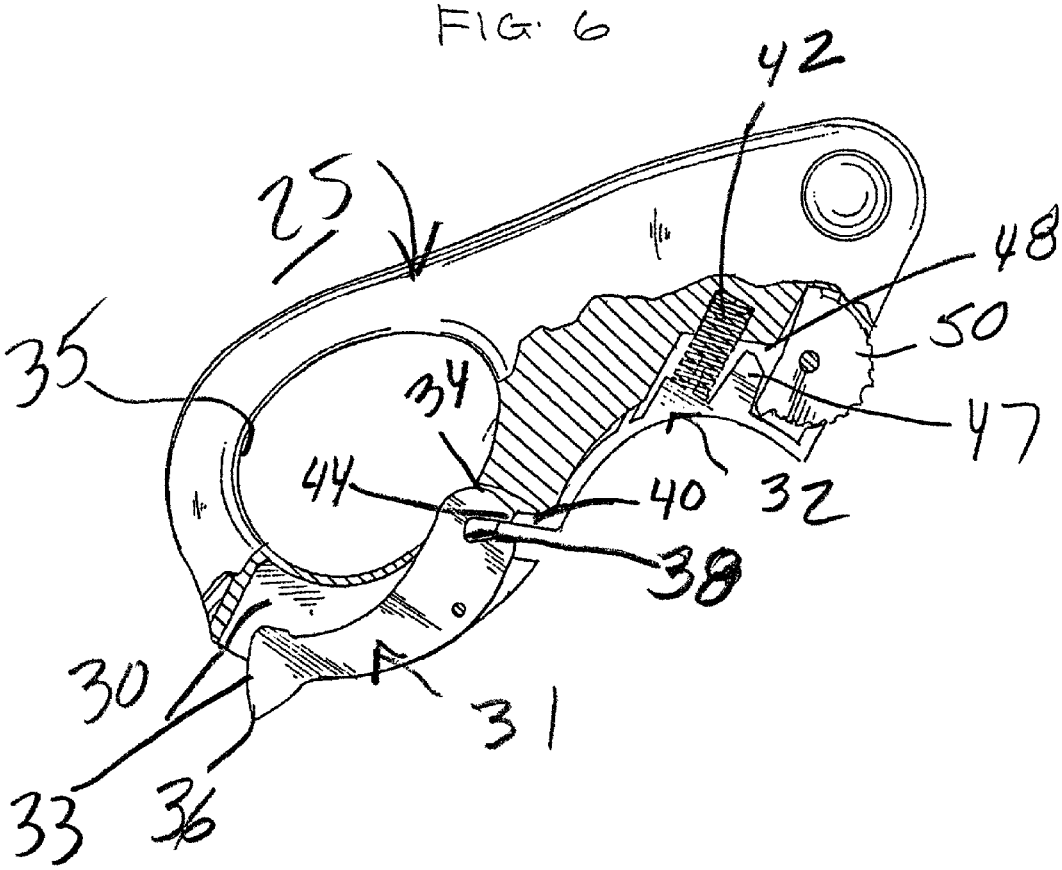
FIG. 6 is a front elevation view, partially in cross-section, of the arm member within which the movable blade member is retained, depicted with the blade member in its fully deployed position.

As best seen in FIGS. 4, 5, and 6, handle member 20 preferably comprises a generally conventional overall visual appearance, incorporating finger loop 35 for enabling handle member 25 to be easily operated when desired by the user. In addition, as discussed above, cavity 30 is formed in handle member 25 dimensioned for receiving and storing movable blade member 31.

Blade member 31 preferably comprises an elongated, arcuate shape, which is constructed to conform to the overall dimension of receiving cavity 30, and comprises opposed ends 33 and 34. In order to provide the requisite cutting capability for easily severing sealing material, such as cellophane tape, ribbons, strapping tape, adhesive tape and the like, movable blade 31 incorporates cutting element or blade portion 36 formed in end 33. Preferably blade portion 36 is constructed with a sharp cutting edge for ease of use in accomplishing the intended tasks.

In addition, in the preferred construction, movable blade 31 is mounted in cavity 30 of handle portion 25 for pivoting movement relative to cavity 30. As depicted, movable blade 31 is mounted in cavity 30 by pivot pin 37. As is more fully detailed below, this securement construction enables cutting blade 31 to be movable from its completely stored position, as shown in FIGS. 4 and 5, with cutting blade portion 36 completely retained within cavity 30, to its deployed position, as shown in FIG. 6, with cutting blade portion 36 extending outwardly from cavity 30 of handle member 25.

In completing the construction of movable blade 31, an activation control slot 38 is formed in end 34 thereof and positioned for cooperating with trigger 32 in controlling the arcuate pivoting movement of blade member 31. As depicted, and further detailed below, activation control slot 38 is formed in movable blade member 31 in end 34, spaced away from pivot axis defining pin member 37. In addition, cutting blade portion 36 is formed on movable blade member 31 in end 33, at a spaced position from pivot axis defining pin member 37. As a result of this construction, activation of control slot 38 causes blade member 31 to move about pin member 37 resulting in the movement of cutting blade portion 36 out of cavity 30.

In order to control the movement of blade member 31, trigger 32 incorporates flange 40 which is normally engaged within activation control slot 38 of movable blade member 31. In the preferred embodiment, trigger 32 is constructed for movement relative to handle portion 25 in the direction of arrow 41.

In addition, spring means 42 is preferably mounted between trigger 32 and handle portion 25 for continuously biasing trigger 32 into its fully extended position, depicted in FIGS. 4 and 5. In this position, flange 40 is engaged within control slot 38 of movable blade member 31 in a manner which maintains blade member 31 in its stowed position, with cutting blade portion 36 completely retained within cavity 30.

Whenever activation of movable blade member 31 is desired, in order to deploy cutting blade portion 36 of blade member 31, trigger 32 is moved in the direction of arrow 41, causing flange 40 of trigger 32 to force blade member 31 to arcuately pivot about pivot pin 37, while flange 40 moves out of engagement with activation control slot 38 of blade member 31. As is evident from a comparison of FIGS. 5 and 6, this arcuate movement of blade member 31 causes control slot 38 and end 34 of blade member 31 to move towards finger loop 35. Simultaneously therewith, end 33 with blade portion 36 of blade member 31 moves in the opposite direction about pivot pin 37, causing blade portion 36 to be moved outwardly from cavity 30, into its fully deployed, usable position.

In the preferred construction, when cutting blade portion 36 is fully deployed, flange 40 of trigger 32 is engaged with edge 44 of blade member 31. As a result, by holding trigger 32 against the biasing forces of spring means 42, positive holding engagement of blade member 31 is achieved. In this way, assurance is provided that forces can be applied to blade portion 36, without causing blade member 31 to be moved or pivoted when not desired. As a result, any cutting desired by the user can be achieved quickly, easily, and conveniently.

When the desired use of blade portion 36 is completed, the actuating force is removed from trigger 32. Once this force is a removed, spring means 42 causes trigger 32 to return to its original position, as shown in FIG. 5. During this return movement, flange 40 is first disengaged from contact with edge 44 of blade member 31 and then enters activation control slot 38. Once flange 40 has entered control slot 38, flange 40 continues to advance into slot 38, causing blade member 31 to arcuately pivot about pin 37. This arcuate pivoting movement continues until blade member 31 has been returned to its initial position, with blade portion 36 fully retained and stowed in cavity 30. In this way, movable blade member 31 is quickly, easily, and automatically returned to its original position.

Whenever the user wishes to employ blade portion 36, the process detailed above is repeated, with blade portion 36 always returning to its original, stowed position, whenever the activation force is removed from trigger 32. In this way, ease of use of blade portion 36 is attained in a simple, straightforward, and convenient manner.

In the preferred embodiment of the present invention, a further feature is incorporated into combined scissors and box cutting product 20. This feature is to provide positive locking means for preventing the actuation of movable blade member 31 when not desired by the user. By referring to FIGS. 4 and 5, along with following detailed disclosure, the construction and operation of this preferred embodiment can best be understood.

Directly adjacent spring means 42, trigger member 32 incorporates finger member 47 which is positioned for cooperating with cavity 48 formed in handle portion 25. As shown in FIGS. 5 and 6, whenever trigger member 32 is activated, finger member 47 enters cavity 48, enabling trigger 32 to be moved through its full travel distance. However, in order to provide a positive lock, for preventing trigger 32 to be activated, when use thereof is not required, combined scissors and box cutting product 20 incorporates wheel member 50 mounted to handle portion 25 directly adjacent finger member 47.

In the preferred construction, wheel member 50 is mounted to handle portion 25 for limited arcuate movement relative to handle portion 25, with an outer edge thereof extending outwardly from handle portion 25 for ease of access by the user. In addition, wheel member 50 incorporates raised boss member 51 extending from the interior terminating edge thereof, with boss member 51 positioned in cooperating relationship with finger member 47.

In the preferred embodiment, wheel member 50 is movable between two positions, one of which has boss member 51 disengaged from any contact with finger member 47, as a depicted in FIG. 5. As described above, in this unlocked position, trigger member 32 is freely movable. However, whenever locked engagement of trigger member 32 is desired, wheel member 50 is arcuately pivoted into its second position wherein boss member 51 of wheel member 50 is engaged with the terminating end of finger member 47. When in this position, trigger 32 is incapable of being moved and remains locked in its normal position.

In order to control the arcuate movement of wheel member 50, wheel member 50 also incorporates boss 52 formed at the opposed interior end thereof, which is mounted in receiving zone 53 of handle member 25. By incorporating boss 52 in receiving zone 53, the arcuate movement of wheel member 50 is controlled and limited to the precisely required travel distance.

It will thus be seen that the object set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

The invention claimed is:

1. A multi-purpose cutting implement for enabling a user to achieve a wide range of independent tasks, said cutting implement comprising:

A. a first arm member comprising a first blade portion and a first handle portion;

B. a second arm member comprising a second blade portion and a second handle portion;

C. said first and second arm members being cooperatively associated with each other for enabling the blade portions thereof to provide a desired cutting action;

D. a separate and independent cutting element a. mounted to said first handle portion; and b. movable between a first stowed position and a second deployed position wherein said cutting element is maintained outwardly from the first handle portion in position for use; and E. trigger means controllably connected to the cutting element and responsive to the receipt of an activation force for moving the cutting element from its stowed position to its deployed position and maintaining the cutting element in its deployed position until the activation force is removed to automatically move the cutting element to its stowed position;

whereby a multi-purpose cutting implement is attained which is capable of providing conventional cutting or shearing action while also providing a separate and independent cutting element which is easily activated for independent use.

2. The multi-purpose cutting implement defined in claim 1, wherein said first arm member and said second arm member are further defined as being pivotally mounted to each other for cooperative use.

3. The multi-purpose cutting implement defined in claim 2, wherein said independent cutting element is further defined as being formed on an elongated support member, and said elongated support member is mounted to said first handle portion for pivotal movement relative thereto about a pivot axis.

4. The multipurpose cutting implement defined in claim 3, wherein said first handle portion is further defined as comprising a cavity formed therein for receiving and storing the separate and independent cutting element and the elongated support member in its entirety when not in use.

5. The multi-purpose cutting implement defined in claim 4, wherein the trigger means is further defined as being controllably associated with the elongated support member for producing arcuate pivoting movement thereof in response to movement of the trigger means.

6. The multipurpose cutting implement defined in claim 5, wherein the elongated support member is further defined as comprising the cutting element formed at a first end thereof and a slot formed in a second, opposed end thereof.

7. The multi-purpose cutting implement defined in claim 6, wherein the trigger means is further defined as comprising a trigger element mounted to the first handle portion for movement between a first position and a second position.

8. The multi-purpose cutting implement defined in claim 7, wherein the trigger element is further defined as being cooperatively associated with a spring member mounted in the first handle portion for normally biasing and maintaining the trigger element in its first position.

9. The multi-purpose cutting implement defined in claim 8, wherein said trigger element is further defined as comprising a flange portion positioned for cooperative, sliding engagement in the slot of the elongated support member for controllably causing said elongated support member to pivot about its pivot axis in response to the movement of the trigger element from its first position to its second position.

10. The multi-purpose cutting implement defined in claim 9, wherein the movement of the trigger element from its first position to its second position causes the second end of the elongated support member to move inwardly relative to said first handle portion while simultaneously causing the first end of the elongated support member to move outwardly from said first handle portion, whereby said cutting element is automatically moved from its stored position to its deployed position.

11. The multi-purpose cutting implement defined in claim 1, wherein said implement further comprises locking means mounted to the first handle portion for cooperating with the trigger means to prevent movement of the trigger means when in a first position and enabling movement of the trigger means when in a second position.

12. The multi-purpose cutting implement defined in claim 11, wherein said locking means is further defined as comprising a movable wheel member pivotally mounted to the first handle portion and incorporating a radially extending edge accessible by the user for controlling the movement thereof.

13. The multi-purpose cutting implement defined in claim 12, wherein said trigger means is further defined as comprising a locking finger and the wheel member of the locking means incorporates a protruding boss cooperatively associated with the locking finger for engaging the locking finger when the wheel member is in a first position, preventing movement of the trigger means, and releasing the locking finger when the wheel member is in a second position, thereby enabling movement of the trigger means.

14. A multi-purpose cutting implement for enabling a user to achieve a wide range of independent tasks, said cutting implement comprising:

A. a first arm member comprising a first blade portion and a first handle portion;

B. a second arm member comprising a second blade portion and a second handle portion;

C. said first and second arm members being pivotally mounted to each other to provide the desired cutting action;

D. an elongated support member a. mounted to said first handle portion for arcuate pivoting movement relative thereto about a pivot axis, b. movable between a first stowed position and a second deployed position, c. comprising a first end incorporating an elongated slot formed therein, and d. comprising a second end incorporating a separate and independent cutting blade formed thereon;

E. a movable trigger a. mounted to the first handle portion and movable between a first position and a second position;

b. cooperatively associated with the elongated support member for moving the elongated support member from its stowed position to its deployed position in response to an activation force.

15. The multi-purpose cutting implement defined in claim 14, wherein the trigger is further defined as being cooperatively associated with a spring member mounted in the first handle portion for normally biasing and maintaining the trigger in its first position.

16. The multi-purpose cutting implement defined in claim 15, wherein said trigger is further defined as comprising a flange portion positioned for cooperative, sliding engagement in the slot of the elongated support member for controllably causing said elongated support member to pivot about its pivot axis in response to the movement of the trigger from its first position to its second position.

17. The multi-purpose cutting implement defined in claim 16, wherein the movement of the trigger from its first position to its second position causes the second end of the elongated support member to move inwardly relative to said first handle portion while simultaneously causing the first end of the elongated support member to move outwardly from said first handle portion, whereby said cutting blade is automatically moved from its deployed position to its stored position.

* * * * *